US009551135B2

(12) United States Patent
Bors et al.

(10) Patent No.: US 9,551,135 B2
(45) Date of Patent: Jan. 24, 2017

(54) MOUNTING SYSTEM FOR PLUMBING FIXTURE FITTING

(71) Applicants: Mark S. Bors, Grafton, OH (US); Jeremy S. Culmer, Parma, OH (US)

(72) Inventors: Mark S. Bors, Grafton, OH (US); Jeremy S. Culmer, Parma, OH (US)

(73) Assignee: Moen Incorporated, North Olmsted, OH (US)

( * ) Notice: Subject to any disclaimer, the term of this patent is extended or adjusted under 35 U.S.C. 154(b) by 870 days.

(21) Appl. No.: 13/768,599

(22) Filed: Feb. 15, 2013

(65) Prior Publication Data

US 2014/0230144 A1 Aug. 21, 2014

(51) Int. Cl.
*E03C 1/181* (2006.01)
*E03C 1/04* (2006.01)

(52) U.S. Cl.
CPC ..... *E03C 1/0401* (2013.01)

(58) Field of Classification Search
CPC ..... E03C 1/0403; E03C 1/0401
USPC ..... 4/675–678, 695
See application file for complete search history.

(56) References Cited

U.S. PATENT DOCUMENTS

| | | | | |
|---|---|---|---|---|
| 4,487,089 | A * | 12/1984 | Harwood | G05G 5/16 74/531 |
| 4,989,633 | A | 2/1991 | Humpert et al. | |
| 5,465,749 | A | 11/1995 | Sauter et al. | |
| 5,515,882 | A | 5/1996 | Hennis | |
| 5,950,663 | A | 9/1999 | Bloomfield | |
| 6,209,153 | B1 | 4/2001 | Segien, Jr. | |
| 6,334,226 | B1 | 1/2002 | Tokunaga et al. | |
| 6,370,712 | B1 | 4/2002 | Burns et al. | |
| 6,405,749 | B1 * | 6/2002 | Bloom | E03C 1/0401 137/359 |
| 6,431,610 | B1 * | 8/2002 | Ohirano | E03C 1/0403 137/15.09 |
| 6,631,730 | B1 | 10/2003 | Bloom et al. | |
| 7,003,818 | B2 | 2/2006 | McNerney et al. | |
| 7,162,755 | B2 | 1/2007 | Mintz et al. | |
| 7,540,300 | B2 | 6/2009 | Thomas et al. | |
| 7,658,202 | B2 | 2/2010 | Mueller et al. | |
| 7,979,929 | B2 | 7/2011 | Vogel et al. | |
| 2009/0000026 | A1 | 1/2009 | Hanson | |
| 2011/0073205 | A1 * | 3/2011 | Marty | E03C 1/0403 137/801 |

* cited by examiner

*Primary Examiner* — Lauren Crane
(74) *Attorney, Agent, or Firm* — Calfee, Halter & Griswold LLP

(57) ABSTRACT

The present invention provides a mounting system for a plumbing fixture fitting that provides a secure mounting even when the mounting conditions are not optimal.

20 Claims, 9 Drawing Sheets

26
50
46
38
42
40

26
46
48
42
46
44

42
40
26
46
38

48
40
42
26
44
50
38

26
46
50
3e
42
46
44
3e 32
52
54
56
58
60
62
64
66
68
70
72
74
76
78
80
82
84
4a
4f

MOUNTING SYSTEM FOR PLUMBING FIXTURE FITTING

FIELD

The present invention relates generally to a mounting system for a plumbing fixture fitting, and, more particularly, to a mounting system for a plumbing fixture fitting that provides a secure mounting even when the mounting conditions are not optimal.

BACKGROUND

When installing a plumbing fixture fitting, such as a faucet, the underside or backside of the mounting surface needs to be even in order for the faucet components, such as a spout and/or a handle, to be securely mounted to the mounting surface. If the underside or backside of the mounting surface is uneven, the faucet components may not be securely mounted to the mounting surface.

SUMMARY

The present invention provides a mounting system for a plumbing fixture fitting that provides a secure mounting even when the mounting conditions are not optimal.

In an exemplary embodiment, the mounting system includes a housing, a bracket, and a bushing. The housing includes a top end and a bottom end. The top end is operable to connect to a plumbing fixture fitting component. The bottom end is operable to connect to a water line. The housing includes an outer surface and an inner surface. The bracket includes a base portion and a protrusion. The base portion has a top side and a bottom side. The base portion has an opening extending from the top side through the bottom side. The opening has a perimeter. The protrusion extends upwardly from the top side of the base portion around at least a portion of the perimeter of the opening in the base portion. The protrusion has a top side and a bottom side. The protrusion has an outer surface and an inner surface. At least a portion of the inner surface of the protrusion tapers inwardly toward the top side. The bushing has a top side and a bottom side. The bushing has an outer surface and an inner surface. At least a portion of the outer surface of the bushing tapers inwardly toward the top side. The bracket is operable to be slid on the housing until at least a portion of the bracket abuts an underside of a mounting surface. The bushing is operable to be slid on the housing and into the protrusion on the bracket. The interaction of the tapered protrusion on the bracket with the tapered bushing enables the bracket to pivot about the bushing.

In an exemplary embodiment, the mounting system includes a bracket and a bushing. The bracket includes a base portion and a protrusion. The base portion has a top side and a bottom side. The base portion has an opening extending from the top side through the bottom side. The opening has a perimeter. The protrusion extends upwardly from the top side of the base portion around at least a portion of the perimeter of the opening in the base portion. The protrusion has a top side and a bottom side. The protrusion has an outer surface and an inner surface. At least a portion of the inner surface of the protrusion tapers inwardly toward the top side. The bushing has a top side and a bottom side. The bushing has an outer surface and an inner surface. At least a portion of the outer surface of the bushing tapers inwardly toward the top side. The bracket is operable to be slid on a housing for a plumbing fixture fitting until at least a portion of the bracket abuts an underside of a mounting surface. The bushing is operable to be slid on the housing and into the protrusion on the bracket. The interaction of the tapered protrusion on the bracket with the tapered bushing enables the bracket to pivot about the bushing.

In an exemplary embodiment, the mounting system includes a bracket and a bushing. The bracket includes a base portion and a protrusion. The base portion has a top side and a bottom side. The base portion has an opening extending from the top side through the bottom side. The opening has a perimeter. The protrusion extends upwardly from the top side of the base portion around at least a portion of the perimeter of the opening in the base portion. The protrusion has a top side and a bottom side. The protrusion has an outer surface and an inner surface. At least a portion of the inner surface of the protrusion tapers inwardly toward the top side. The inner surface of the protrusion is generally non-circular. The bushing has a top side and a bottom side. The bushing has an outer surface and an inner surface. At least a portion of the outer surface of the bushing tapers inwardly toward the top side. The outer surface of the bushing is generally non-circular. The bushing has a split. The bracket is operable to be slid on a housing for a plumbing fixture fitting until at least a portion of the bracket abuts an underside of a mounting surface. The bushing is operable to be slid on the housing and into the protrusion on the bracket. The split in the bushing enables the bushing to be compressed and move further into the protrusion. The interaction of the tapered protrusion on the bracket with the tapered bushing enables the bracket to pivot about the bushing. The interaction of the non-circular protrusion on the bracket with the non-circular bushing resists rotation between the bracket and the bushing.

BRIEF DESCRIPTION OF THE DRAWINGS

-FIG. 3*a* is a perspective view, FIG. 3*b* is a side elevational view, FIG. 3*c* is a top plan view, FIG. 3*d* is a bottom plan view, and FIG. 3*e* is a cross-sectional view taken along the line 3*e*-3*e* in FIG. 3*c;*

*-FIG. 4*a* is a perspective view, FIG. 4*b* is a top plan view, FIG. 4*c* is a side elevational view, FIG. 4*d* is another side elevational view, FIG. 4*e* is a cross-sectional view taken along the line 4*e*-4*e* in FIG. 4*b*, and FIG. 4*f* is a cross-sectional view taken along the line 4*f*-4*f* in FIG. 4*b;*

-FIG. 5*a* is a perspective view, FIG. 5*b* is a side elevational view, FIG. 5*c* is another side elevational view, FIG. 5*d* is a top plan view, FIG. 5*e* is a bottom plan view, and FIG. 5*f* is a cross-sectional view taken along the line 5*f*-5*f* in FIG. 5*e;*

*-FIG. 6*a* is a perspective view, FIG. 6*b* is a top plan view, FIG. 6*c* is a side elevational view, FIG. 6*d* is another side elevational view, FIG. 6*e* is a cross-sectional view taken along the line 6*e*-6*e* in FIG. 6*b*, and FIG. 6*f* is a cross-sectional view taken along the line 6*f*-6*f* in FIG. 6*b;*

-FIG. 7*a* is a perspective view, FIG. 7*b* is a top plan view, FIG. 7*c* is a side elevational view, FIG. 7*d* is another side elevational view, FIG. 7*e* is a cross-sectional view taken along the line 7*e*-7*e* in FIG. 7*b*, FIG. 7*f* is a cross-sectional view taken along the line 7*f*-7*f* in FIG. 7*b*, and FIG. 7*g* is a cross-sectional view taken along the line 7*g*-7*g* in FIG. 7*b;*

DETAILED DESCRIPTION

Figure 1:
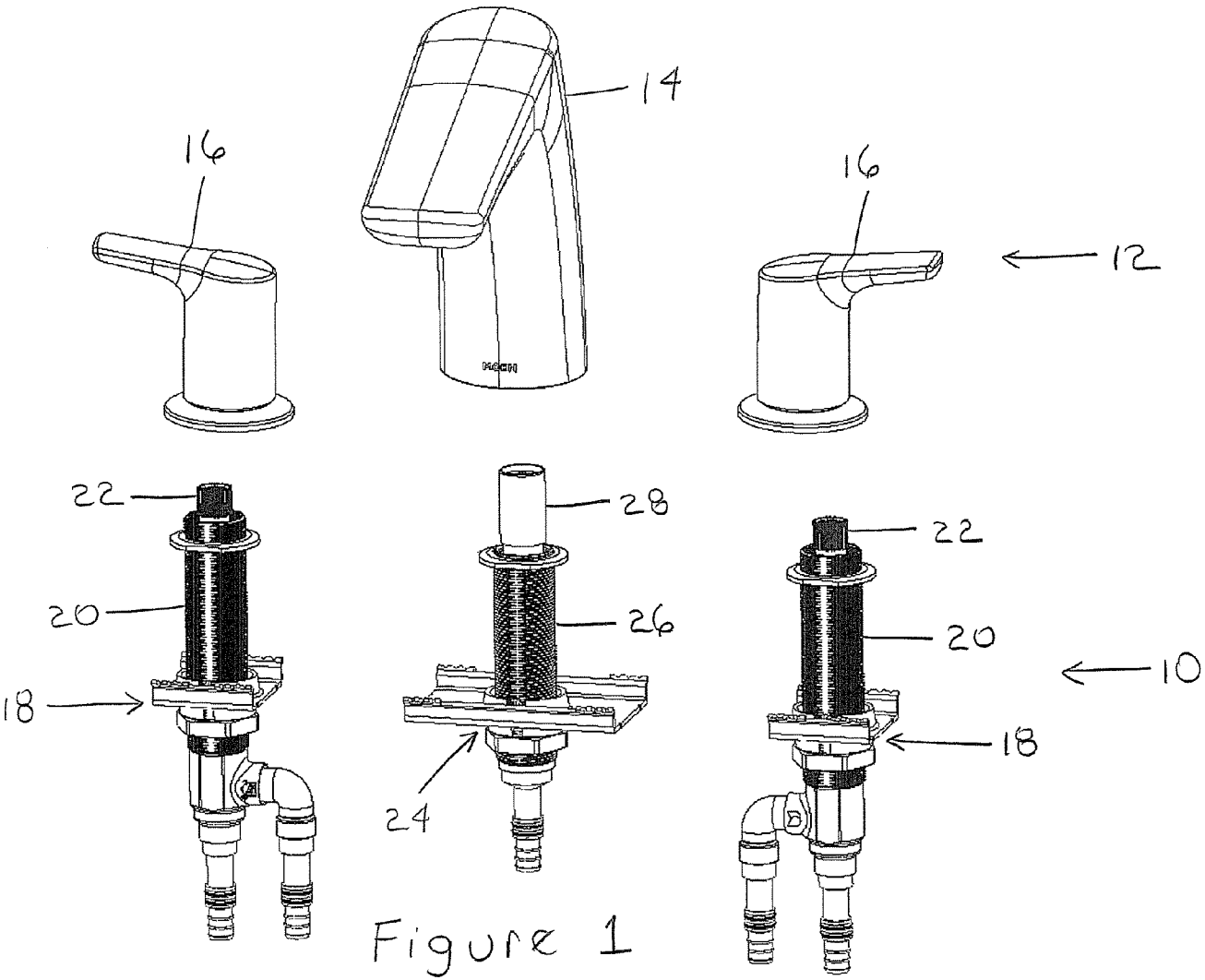
FIG. 1 is an exploded perspective view of a mounting system for a plumbing fixture fitting according to an exemplary embodiment of the present invention.

The present invention provides a mounting system for a plumbing fixture fitting that provides a secure mounting even when the mounting conditions are not optimal.

An exemplary embodiment of a mounting system 10 for a faucet 12 of the present invention is shown in FIGS. 1-9. In the illustrated embodiment, the faucet 12 is a roman tub faucet. However, one of ordinary skill in the art will appreciate that the mounting system 10 could be used with any type of plumbing fixture fitting. Additionally, in the illustrated embodiment, the faucet 12 is mounted on a horizontal mounting surface, such as a tub deck or a countertop. However, one of ordinary skill in the art will appreciate that the mounting system 10 could be used with a plumbing fixture fitting mounted on a vertical mounting surface, such as a wall.

The faucet 12 includes a spout 14 and a pair of handles 16. Each handle 16 is associated with a handle mounting system 18 that is mounted partially above and partially below the mounting surface. The handle mounting system 18 includes a valve housing 20. The valve housing 20 houses a valve cartridge 22 and is connected to structure that enables the valve cartridge 22 to receive incoming water from a water supply source and provide outgoing water to the spout 14. The spout 14 is associated with a spout mounting system 24 that is mounted partially above and partially below the mounting surface. The spout mounting system 24 includes a shank housing 26. The shank housing 26 houses a shank 28 and is connected to structure that enables the spout 14 to receive incoming water from the valve cartridges 22 and provide outgoing water to a user of the faucet 12.

Figure 2:
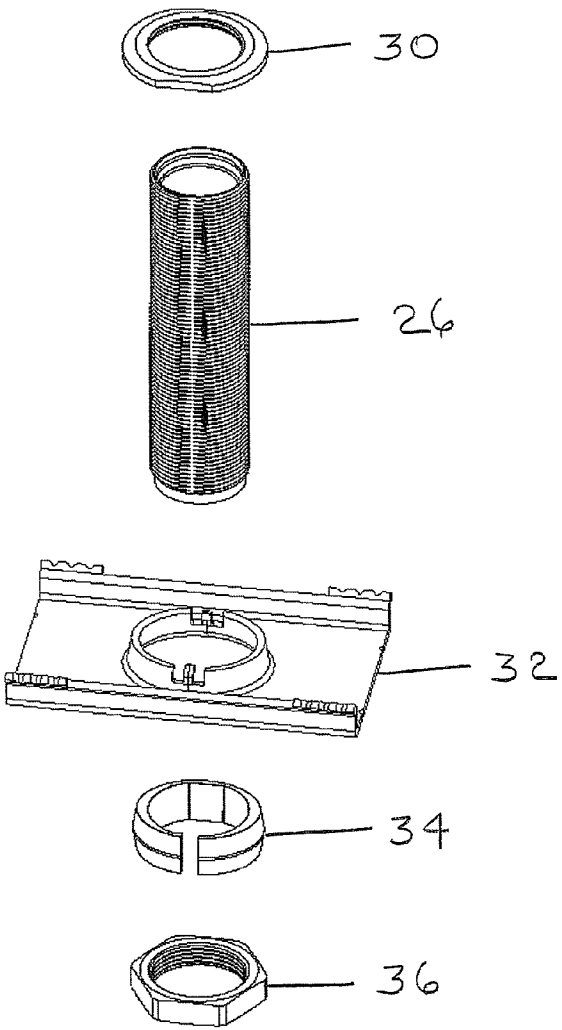
FIG. 2 is an exploded perspective view of components of the mounting system of FIG. 1.
Figures 3A, 3B, 3C, 3D, 3E:
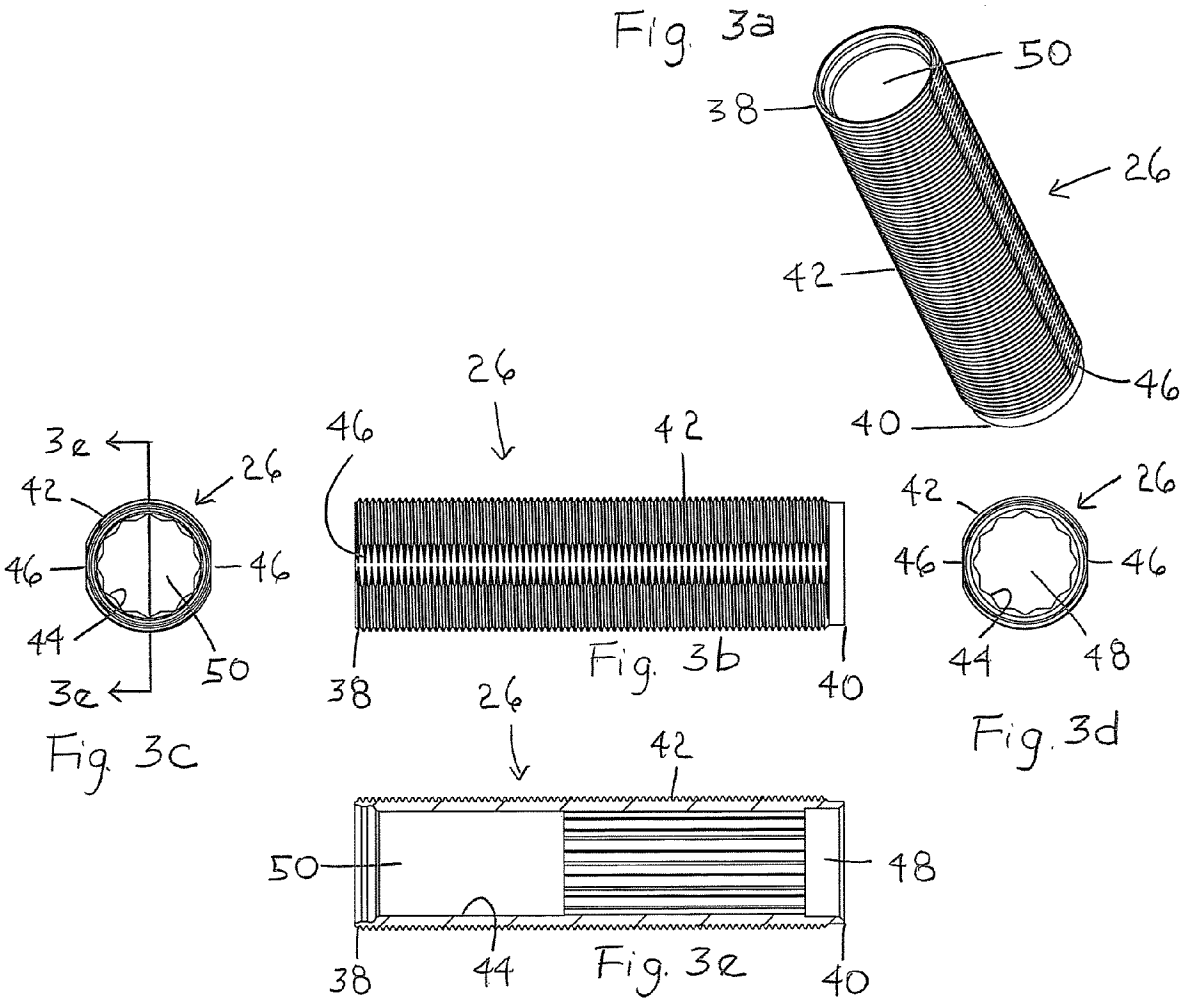
FIGS. 3*a*-3*e* are views of a shank housing for use in the mounting system of FIG. 1
Figures 4A, 4B, 4C, 4D, 4E, 4F:
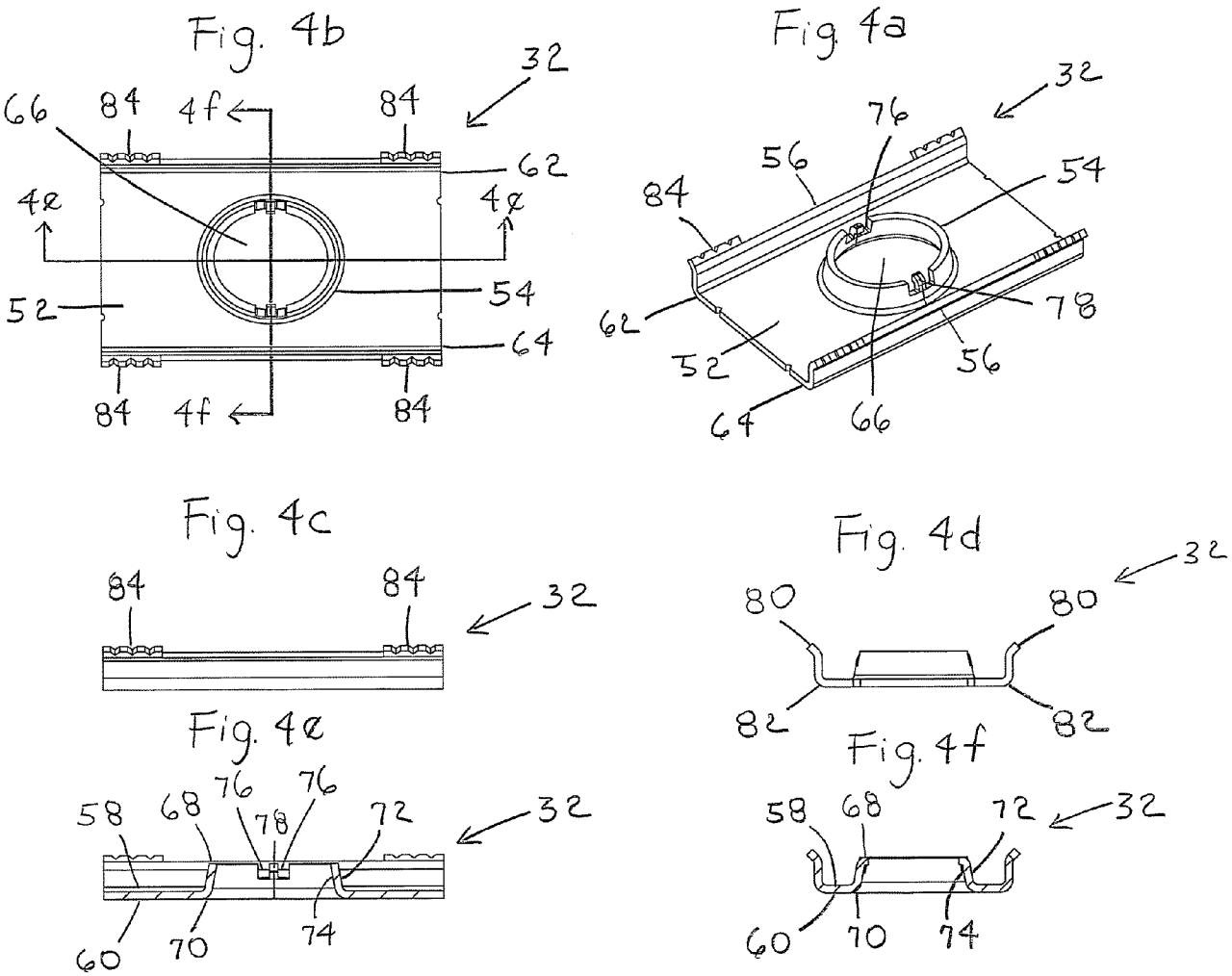
FIGS. 4*a*-4*f* are views of a bracket for use with the shank housing of FIGS. 3*a*-3*e
Figure 5A:
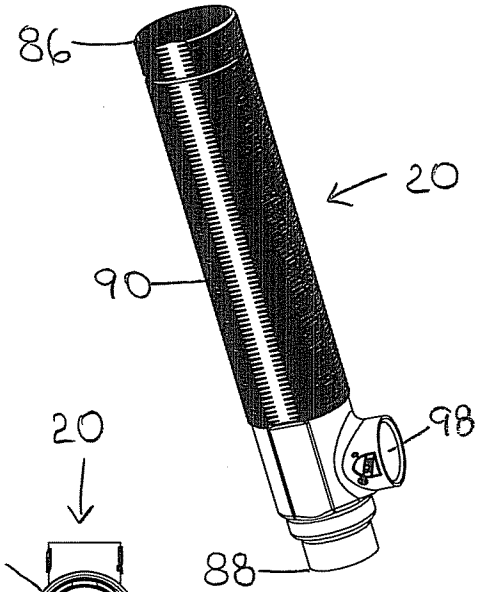
FIGS. 5*a*-5*f* are views of a valve housing for use in the mounting system of FIG. 1
Figure 5D:
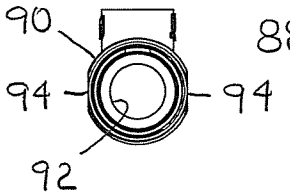
Figure 5B:
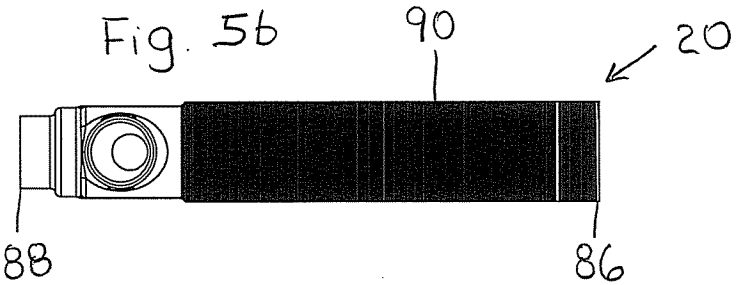
Figure 5C:
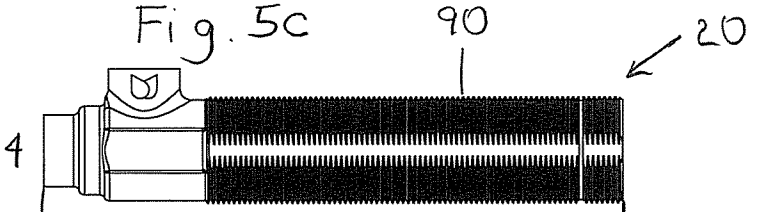
Figure 5F:
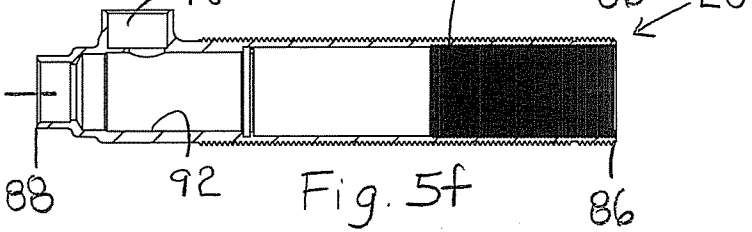
Figure 5E:
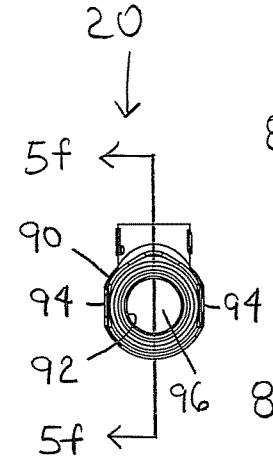
Figure 6A:
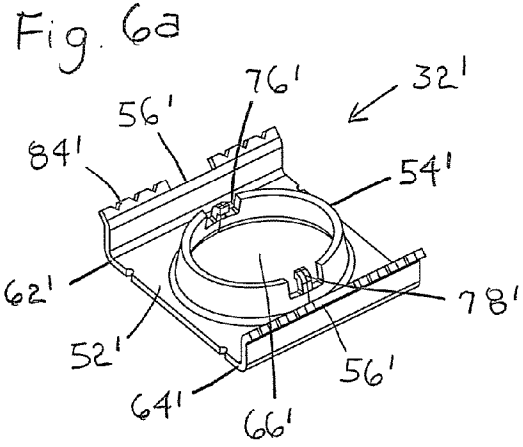
FIGS. 6*a*-6*f* are views of a bracket for use with the valve housing of FIGS. 5*a*-5*f
Figure 6D:
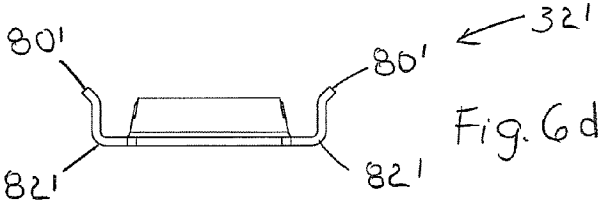
Figure 6F:
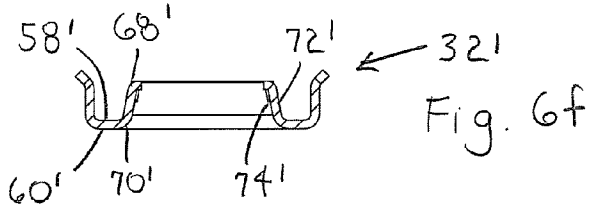
Figure 6B:
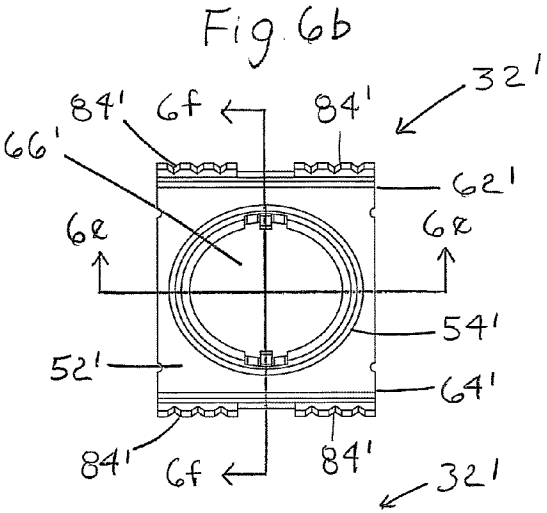
Figure 6C:
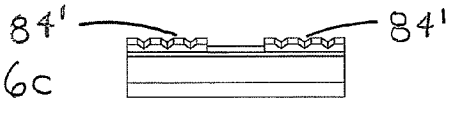
Figure 6E:
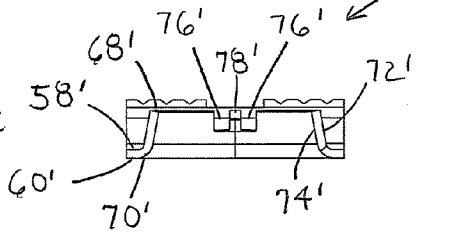
Figure 7A:
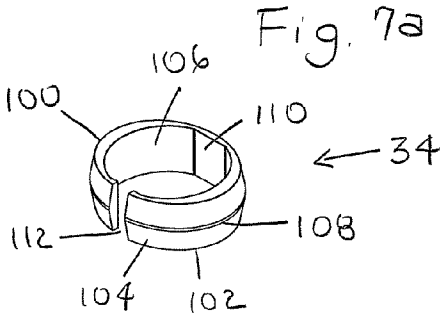
FIGS. 7*a*-7*g* are views of a bushing for use in the mounting system of FIG. 1
Figure 7G:
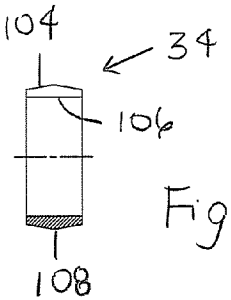
Figure 7E:
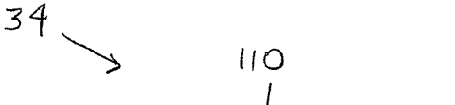
Figure 7C:
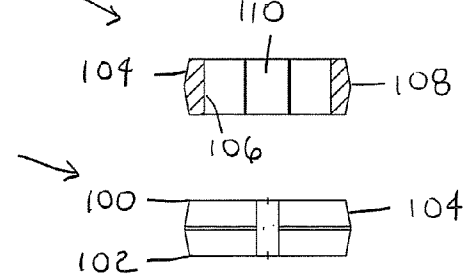
Figure 7B:
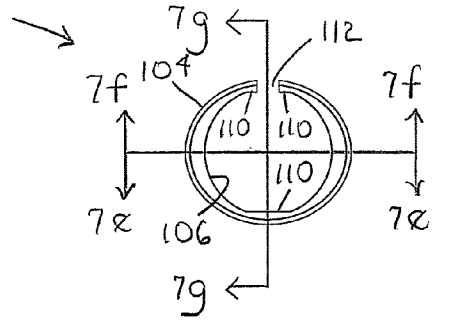
Figure 7D:
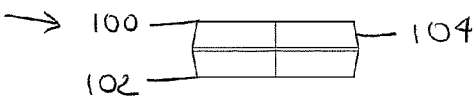
Figure 7F:
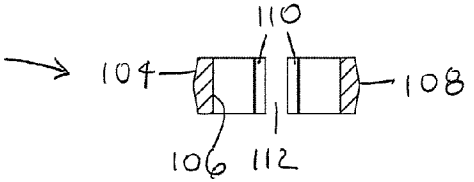

Components of an exemplary embodiment of the mounting system 10 are shown in FIG. 2. In the illustrated embodiment, the mounting system 10 includes a top nut 30, a bracket 32, a bushing 34, and a bottom nut 36. In FIG. 2, the mounting system 10 is shown as used with the shank housing 26 for the spout 14. However, one of ordinary skill in the art will appreciate that the components could be used with the valve housing 20 for the handle 16 as shown in FIG. 1.

An exemplary embodiment of the shank housing 26 for the spout 14 is shown in FIGS. 3*a*-3*e*. In an exemplary embodiment, the shank housing 26 has a generally cylindrical shape. The shank housing 26 includes a top end 38 and a bottom end 40. The top end 38 is operable to be connected, either directly or indirectly, to the spout 14. The shank housing 26 includes an outer surface 42 and an inner surface 44. At least a portion of the outer surface 42 of the shank housing 26 is threaded. At least a portion of the outer surface 42 of the shank housing 26 has two opposing flats 46 extending between the top end 38 and the bottom end 40. The shank housing 26 includes an inlet 48 in the bottom end 40. The inlet 48 is operable to be connected, either directly or indirectly, to an inlet water line. The shank housing 26 includes an outlet 50 in the top end 38. The outlet 50 is operable to be connected, either directly or indirectly, to a waterway in the spout 14. The shank housing 26 can be formed of metal or any other suitable material. In an exemplary embodiment, the shank housing 26 is formed of a brass alloy.

An exemplary embodiment of the bracket 32 for use with the shank housing 26 of FIGS. 3*a*-3*e* is shown in FIGS. 4*a*-4*f*. The bracket 32 includes a base portion 52, a protrusion 54, and two side portions 56. In an exemplary embodiment, the base portion 52 has a generally rectangular shape. However, one of ordinary skill in the art will appreciate that the base portion 52 could have other shapes. The base portion 52 has a top side 58 and a bottom side 60. The base portion 52 also has a first side 62 and a second side 64. The base portion 52 has an opening 66 extending from the top side 58 through the bottom side 60 between the first side 62 and the second side 64. The opening 66 has a perimeter. In an exemplary embodiment, the opening 66 is generally non-circular. In an exemplary embodiment, the opening 66 is generally oval. The protrusion 54 extends upwardly from the top side 58 of the base portion 52 around at least a portion of the perimeter of the opening 66 in the base portion 52. The protrusion 54 has a top side 68 and a bottom side 70. The protrusion 54 has an outer surface 72 and an inner surface 74. At least a portion of the inner surface 74 of the protrusion 54 tapers inwardly toward the top side 68. In an exemplary embodiment, the protrusion 54 is generally non-circular. In an exemplary embodiment, the protrusion 54 is generally oval. In an exemplary embodiment, the protrusion 54 has two gaps 76 and a tooth 78 located in each gap 76. The teeth 78 taper inwardly toward the top side 68 of the protrusion 54. The side portions 56 extend upwardly from the top side 58 of the base portion 52 along the first side 62 and the second side 64 of the base portion 52. The side portions 56 have a top side 80 and a bottom side 82. The side portions 56 include teeth 84 extending upwardly from the top side 80. The bracket 32 can be formed of metal or any other suitable material. In an exemplary embodiment, the bracket 32 is formed of an annealed stainless steel.

An exemplary embodiment of the valve housing 20 for the handle 16 is shown in FIGS. 5*a*-5*f*. In an exemplary embodiment, the valve housing 20 has a generally cylindrical shape. The valve housing 20 includes a top end 86 and a bottom end 88. The top end 86 is operable to be connected, either directly or indirectly, to the handle 16. The valve housing 20 includes an outer surface 90 and an inner surface 92. At least a portion of the outer surface 90 of the valve housing 20 is threaded. At least a portion of the outer surface 90 of the valve housing 20 has two opposing flats 94 extending between the top end 86 and the bottom end 88. The valve housing 20 includes an inlet 96 in the bottom end 88. The inlet 96 is operable to be connected, either directly or indirectly, to an inlet water line. The valve housing 20 includes an outlet 98 near the bottom end 88. The outlet 98 is operable to be connected, either directly or indirectly, to an outlet water line. The valve housing 20 can be formed of metal or any other suitable material. In an exemplary embodiment, the valve housing 20 is formed of a brass alloy.

An exemplary embodiment of a bracket 32' for use with the valve housing 20 of FIGS. 5*a*-5*f* is shown in FIGS. 6*a*-6*f*. The bracket 32' includes a base portion 52', a protrusion 54', and two side portions 56'. In an exemplary embodiment, the base portion 52' has a generally rectangular shape. However, one of ordinary skill in the art will appreciate that the base portion 52' could have other shapes. The base portion 52' has a top side 58' and a bottom side 60'. The base portion 52' also has a first side 62' and a second side 64'. The base portion 52' has an opening 66' extending from the top side 58' through the bottom side 60' between the first side 62' and the second side 64'. The opening 66' has a perimeter. In an exemplary embodiment, the opening 66' is generally non-circular. In an exemplary embodiment, the opening 66' is generally oval. The protrusion 54' extends upwardly from the top side 58' of the base portion 52' around at least a portion of the perimeter of the opening 66' in the base portion 52'. The protrusion 54' has a top side 68' and a bottom side 70'. The protrusion 54' has an outer surface 72' and an inner surface 74'. At least a portion of the inner surface 74' of the protrusion 54' tapers inwardly toward the top side 68'. In an exemplary embodiment, the protrusion 54' is generally non-circular. In an exemplary embodiment, the protrusion 54' is generally oval. In an exemplary embodiment, the protrusion 54' has two gaps 76' and a tooth 78' located in each gap 76'. The teeth 78' taper inwardly toward the top side 68' of the protrusion 54'. The side portions 56' extend upwardly from the top side 58' of the base portion 52' along the first side 62' and the second side 64' of the base portion 52'. The side portions 56' have a top side 80' and a bottom side 82'. The side portions 56' include teeth 84' extending upwardly from the top side 80'. The bracket 32' can be formed of metal or any other suitable material. In an exemplary embodiment, the bracket 32' is formed of an annealed stainless steel.

An exemplary embodiment of the bushing 34 is shown in detail in FIGS. 7*a*-7*g*. In an exemplary embodiment, the bushing 34 has a generally ring shape. The bushing 34 has a top side 100 and a bottom side 102. The bushing 34 has an outer surface 104 and an inner surface 106. In an exemplary embodiment, the outer surface 104 is generally non-circular. In an exemplary embodiment, the outer surface 104 is generally oval. At least a portion of the outer surface 104 of the bushing 34 tapers inwardly toward the top side 100. In an exemplary embodiment, the outer surface 104 tapers inwardly from near a middle 108 of the outer surface 104 toward the top side 100 and from near the middle 108 of the outer surface 104 toward the bottom side 102. In an exemplary embodiment, the inner surface 106 is generally circular. At least a portion of the inner surface 106 of the bushing 34 has two opposing flats 110 extending between the top side 100 and the bottom side 102. The bushing 34 has a split 112. In an exemplary embodiment, the split 112 is in one of the two opposing flats 110. However, one of ordinary skill in the art will appreciate that the split 112 could be in any location around the bushing 34. The bushing 34 can be formed of metal or any other suitable material. In an exemplary embodiment, the bushing 34 is formed of a brass alloy.

For ease of reference, throughout the rest of the specification and the claims, the mounting structure for the faucet component or other plumbing fixture fitting component will be referred to as a housing, regardless of whether the structure is the shank housing 26 for the spout 14, the valve housing 20 for the handle 16, or another housing for another plumbing fixture fitting component. Additionally, the plumbing fixture fitting will be referred to as a faucet, regardless of the type of plumbing fixture fitting.

To install a faucet component (such as the spout 14 or the handle 16) using the mounting system 10, the bottom nut 36, the bushing 34, and the bracket 32, 32' are placed onto the housing 20, 26 for the faucet component 14, 16 from the top end 38, 86 of the housing 20, 26. The housing 20, 26 is then inserted into a hole in the mounting surface (e.g., a tub deck, a countertop, or a wall) from below the mounting surface until the housing 20, 26 is properly located relative to the mounting surface.

The top nut 30 is threaded onto the housing 20, 26 from above the mounting surface securing the housing 20, 26 to the mounting surface.

The bracket 32, 32' is then slid up the housing 20, 26 until at least a portion of the bracket 32, 32' abuts the underside of the mounting surface. The teeth 84, 84' on the bracket 32, 32' resist rotation between the bracket 32, 32' and the underside of the mounting surface.

The bushing 34 is then slid up the housing 20, 26 and into the protrusion 54, 54' on the bracket 32, 32'. The flats 46, 94 on the outer surface 42, 90 of the housing 20, 26 align with the flats 110 on the inner surface 106 of the bushing 34. The interaction of the flats 46, 94 on the housing 20, 26 with the flats 110 on the bushing 34 resists rotation between the housing 20, 26 and the bushing 34.

The bottom nut 36 is then threaded up the housing 20, 26 securing the bracket 32, 32', the bushing 34, and the bottom nut 36 beneath the mounting surface. As the bottom nut 36 is threaded up the housing 20, 26, the bottom nut 36 will move the bushing 34 into the protrusion 54, 54' on the bracket 32, 32'. As the bushing 34 moves into the protrusion 54, 54', the split 112 on the bushing 34 enables the bushing 34 to be compressed and move further into the protrusion 54, 54'. The interaction of the non-circular protrusion 54, 54' on the bracket 32, 32' with the non-circular bushing 34 resists rotation between the bracket 32, 32' and the bushing 34. Additionally, the interaction of the tapered protrusion 54, 54' on the bracket 32, 32' with the tapered bushing 34 enables the bracket 32, 32' to pivot about the bushing 34 which, among other things, enables perpendicular installation of the housing 20, 26 even when the underside of the mounting surface is uneven.

Figure 8:
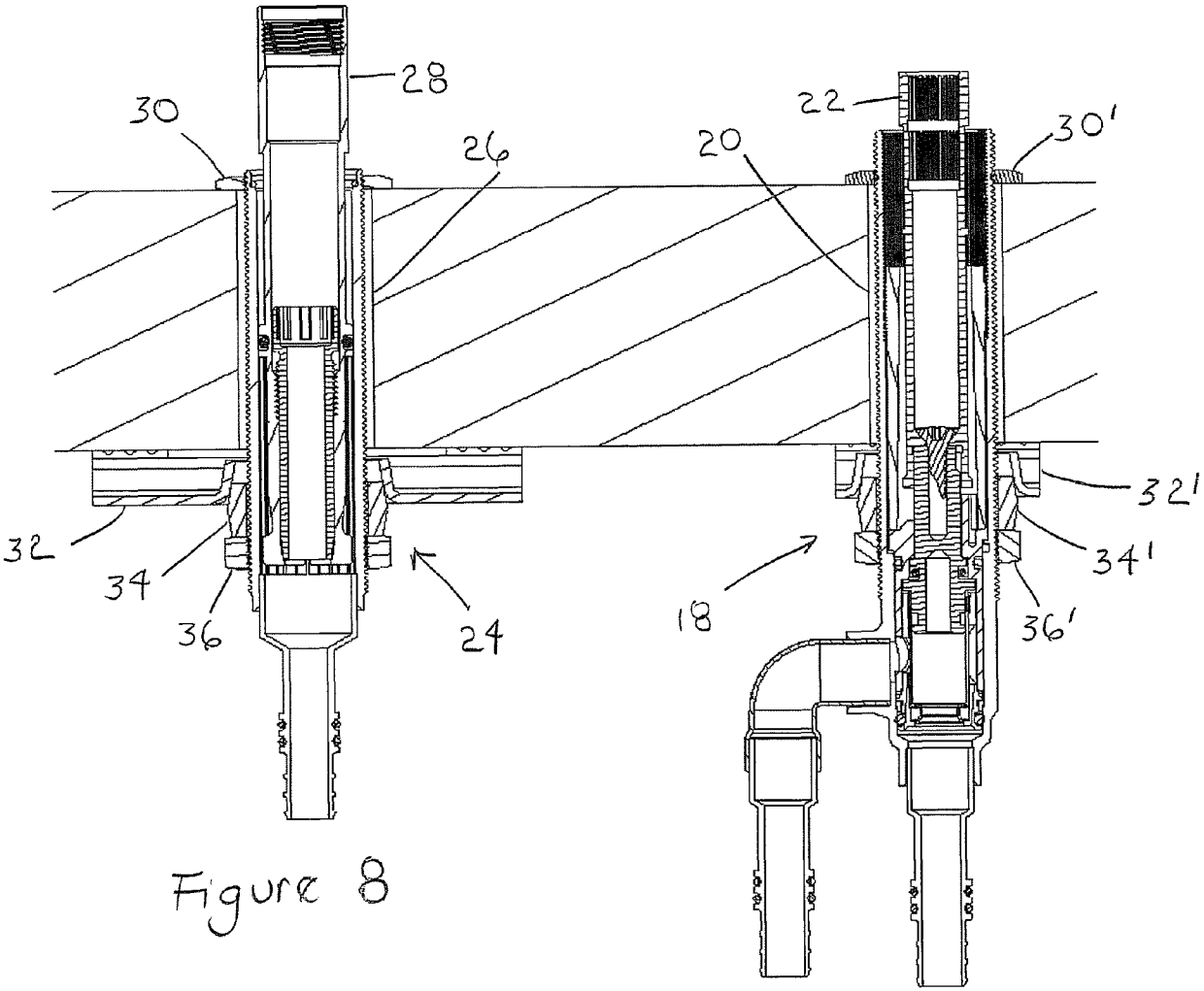
FIG. 8 is a cross-sectional view of portions of the mounting system of FIG. 1, where an underside of a mounting surface is even.

As can be seen in FIG. 8, using the mounting system 10, the faucet components 14, 16 are securely mounted to the mounting surface. In FIG. 8, the underside of the mounting surface is even. However, the underside of the mounting surface does not need to be even in order for the faucet components 14, 16 to be securely mounted to the mounting surface. Using the mounting system 10, if the underside of the mounting surface is uneven, the faucet components 14, 16 can still be securely mounted to the mounting surface.

Figure 9:
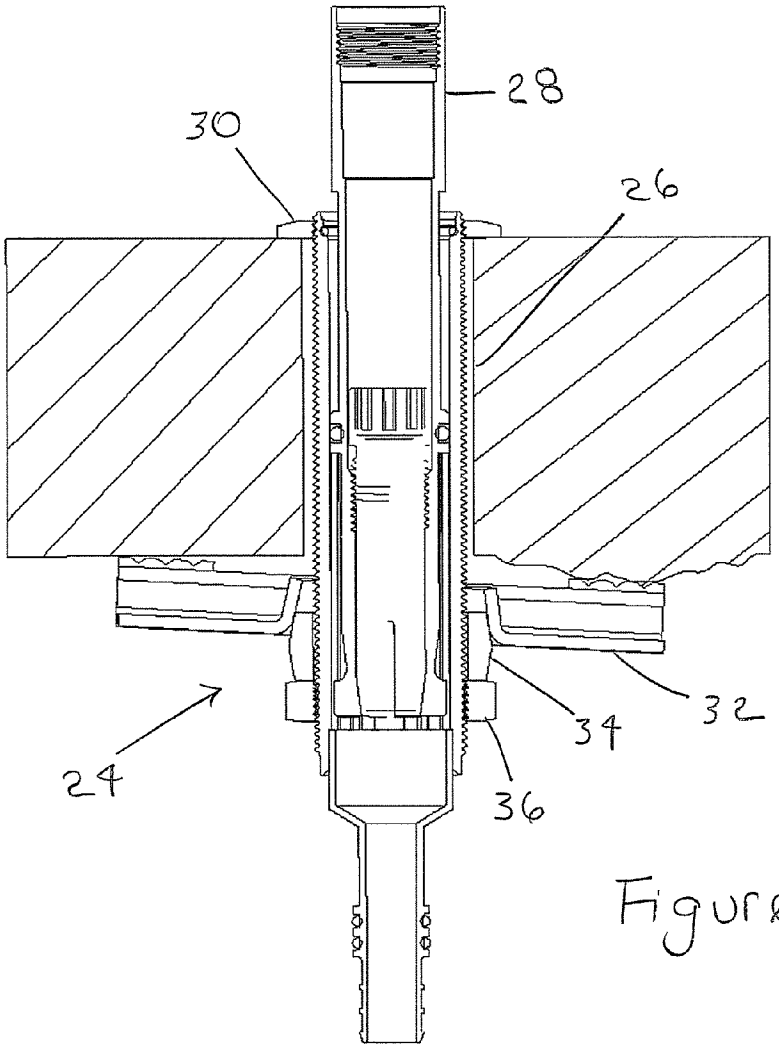
FIG. 9 is a cross-sectional view of portions of the mounting system of FIG. 1, where an underside of a mounting surface is uneven.

As can be seen in FIG. 9, the underside of the mounting surface is uneven. Therefore, the bracket 32 is not completely flush with the underside of the mounting surface. Without the mounting system 10, and in particular, the bracket 32 and the bushing 34, the faucet component 14 may not be securely mounted. However, with the mounting system 10, and in particular, the bracket 32 and the bushing 34, the bracket 32 can be angled so that it can be as flush as possible with the underside of the mounting surface. Since the bracket 32 is as flush as possible, the faucet component 14 can be securely mounted to the mounting surface.

In describing the components of the mounting system 10, terms describing the orientation of the components of the mounting system 10 are used. For example, the valve housing 20 and the shank housing 26 are described as having a top end and a bottom end. Similarly, the bracket 32, 32', the protrusion 54, 54' on the bracket 32, 32', the side portions 56, 56' of the bracket 32, 32', and the bushing 34 are described as having a top side and a bottom side. Additionally, reference is made to mounting components above and below the mounting surface. Likewise, reference is made to moving components up and down the housing 20, 26. These and other terms describe the components of the mounting system 10 as oriented in the drawings. However, one of ordinary skill in the art will appreciate that the mounting system 10 could be oriented in any direction and that these terms are relative terms and are merely used for ease of reference in describing the components of the mounting system 10 and the installation of faucet components 14, 16 using the mounting system 10.

One of ordinary skill in the art will now appreciate that the present invention provides a mounting system for a plumbing fixture fitting that provides a secure mounting even when the mounting conditions are not optimal. Although the present invention has been shown and described with reference to a particular embodiment, equivalent alterations and modifications will occur to those skilled in the art upon reading and understanding this specification. The present invention includes all such equivalent alterations and modifications and is limited only by the scope of the following claims in light of their full scope of equivalents.

What is claimed is:

1. A plumbing fixture fitting, comprising:

a housing, the housing including a top end and a bottom end, the top end being operable to connect to a plumbing fixture fitting component, the bottom end being operable to connect to a water line, the housing including an outer surface and an inner surface;

a bracket, the bracket including a base portion and a protrusion, the base portion having a top side and a bottom side, the base portion having an opening extending from the top side through the bottom side, the opening having a perimeter, the protrusion extending from the base portion around at least a portion of the perimeter of the opening in the base portion, the protrusion having a top side and a bottom side, the protrusion having an outer surface and an inner surface, at least a portion of the inner surface of the protrusion tapering inwardly toward the top side; and a bushing, the bushing having a top side and a bottom side, the bushing having an outer surface and an inner surface, at least a portion of the outer surface of the bushing tapering inwardly toward the top side;

wherein, during installation, the bracket slides on the housing until at least a portion of the bracket abuts an underside of a mounting surface;

wherein, during installation, the bushing slides on the housing and into the protrusion on the bracket; and wherein the interaction of the tapered protrusion on the bracket with the tapered bushing enables the bracket to pivot about the bushing.

2. The plumbing fixture fitting of claim 1, wherein the bushing has a split; and wherein the split in the bushing enables the bushing to be compressed and move further into the protrusion.

3. The plumbing fixture fitting of claim 1, wherein the inner surface of the protrusion is generally non-circular;

wherein the outer surface of the bushing is generally non-circular; and wherein the interaction of the non-circular protrusion on the bracket with the non-circular bushing resists rotation between the bracket and the bushing.

4. The plumbing fixture fitting of claim 3, wherein the inner surface of the protrusion is generally oval; and wherein the outer surface of the bushing is generally oval.

5. The plumbing fixture fitting of claim 1, wherein at least a portion of the outer surface of the housing has a flat extending between the top end and the bottom end;

wherein at least a portion of the inner surface of the bushing has a flat extending between the top side and the bottom side;

wherein the flat on the outer surface of the housing aligns with the flat on the inner surface of the bushing; and wherein the interaction of the flat on the housing with the flat on the bushing resists rotation between the housing and the bushing.

6. The plumbing fixture fitting of claim 5, wherein at least a portion of the outer surface of the housing has two opposing flats extending between the top end and the bottom end; and wherein at least a portion of the inner surface of the bushing has two opposing flats extending between the top side and the bottom side.

7. The plumbing fixture fitting of claim 1, wherein the bracket includes a side portion extending upwardly from the top side of the base portion;

wherein the side portion has a top side and a bottom side;

wherein the side portion includes teeth extending upwardly from the top side; and wherein the teeth resist rotation between the bracket and the underside of the mounting surface.

8. The plumbing fixture fitting of claim 7, wherein the bracket includes a side; and wherein the side portion extends upwardly from the top side of the base portion along the side of the base portion.

9. The plumbing fixture fitting of claim 1, wherein at least a portion of the outer surface of the bushing tapers inwardly toward the bottom side.

10. The plumbing fixture fitting of claim 1, wherein the inner surface of the bushing is generally circular.

11. The plumbing fixture fitting of claim 1, wherein at least a portion of the outer surface of the housing is threaded.

12. The plumbing fixture fitting of claim 11, further including a bottom nut;

wherein the bottom nut is operable to be threaded on the housing from below the mounting surface securing the bracket, the bushing, and the bottom nut beneath the mounting surface; and wherein, as the bottom nut is threaded on the housing, the bottom nut moves the bushing into the protrusion on the bracket.

13. The plumbing fixture fitting of claim 11, further including a top nut;

wherein the top nut is operable to be threaded on the housing from above the mounting surface securing the housing to the mounting surface.

14. A mounting system for a plumbing fixture fitting, the mounting system comprising:

a bracket, the bracket including a base portion and a protrusion, the base portion having a top side and a bottom side, the base portion having an opening extending from the top side through the bottom side, the opening having a perimeter, the protrusion extending from the base portion around at least a portion of the perimeter of the opening in the base portion, the protrusion having a top side and a bottom side, the protrusion having an outer surface and an inner surface, at least a portion of the inner surface of the protrusion tapering inwardly toward the top side; and a bushing, the bushing having a top side and a bottom side, the bushing having an outer surface and an inner surface, at least a portion of the outer surface of the bushing tapering inwardly toward the top side;

wherein, during installation, the bracket slides on a housing for a plumbing fixture fitting until at least a portion of the bracket abuts an underside of a mounting surface;

wherein, during installation, the bushing slides on the housing and into the protrusion on the bracket; and wherein the interaction of the tapered protrusion on the bracket with the tapered bushing enables the bracket to pivot about the bushing.

15. The mounting system of claim 14, wherein the bushing has a split; and wherein the split in the bushing enables the bushing to be compressed and move further into the protrusion.

16. The mounting system of claim 14, wherein the inner surface of the protrusion is generally non-circular;

wherein the outer surface of the bushing is generally non-circular; and wherein the interaction of the non-circular protrusion on the bracket with the non-circular bushing resists rotation between the bracket and the bushing.

17. The mounting system of claim 14, wherein at least a portion of the outer surface of the housing has a flat extending between the top end and the bottom end;

wherein at least a portion of the inner surface of the bushing has a flat extending between the top side and the bottom side;

wherein the flat on the outer surface of the housing aligns with the flat on the inner surface of the bushing; and wherein the interaction of the flat on the housing with the flat on the bushing resists rotation between the housing and the bushing.

18. The mounting system of claim 14, wherein the bracket includes a side portion extending upwardly from the top side of the base portion;

wherein the side portion has a top side and a bottom side;

wherein the side portion includes teeth extending upwardly from the top side; and wherein the teeth resist rotation between the bracket and the underside of the mounting surface.

19. The mounting system of claim 14, further including a bottom nut;

wherein at least a portion of the outer surface of the housing is threaded;

wherein the bottom nut is operable to be threaded on the housing from below the mounting surface securing the bracket, the bushing, and the bottom nut beneath the mounting surface; and wherein, as the bottom nut is threaded on the housing, the bottom nut moves the bushing into the protrusion on the bracket.

20. A mounting system for a plumbing fixture fitting, the mounting system comprising:

a bracket, the bracket including a base portion and a protrusion, the base portion having a top side and a bottom side, the base portion having an opening extending from the top side through the bottom side, the opening having a perimeter, the protrusion extending from the base portion around at least a portion of the perimeter of the opening in the base portion, the protrusion having a top side and a bottom side, the protrusion having an outer surface and an inner surface, at least a portion of the inner surface of the protrusion tapering inwardly toward the top side, the inner surface of the protrusion being generally non-circular; and a bushing, the bushing having a top side and a bottom side, the bushing having an outer surface and an inner surface, at least a portion of the outer surface of the bushing tapering inwardly toward the top side, the outer surface of the bushing being generally non-circular, the bushing having a split;

wherein, during installation, the bracket slides on a housing for a plumbing fixture fitting until at least a portion of the bracket abuts an underside of a mounting surface;

wherein, during installation, the bushing slides on the housing and into the protrusion on the bracket;

wherein the split in the bushing enables the bushing to be compressed and move further into the protrusion;

wherein the interaction of the tapered protrusion on the bracket with the tapered bushing enables the bracket to pivot about the bushing; and wherein the interaction of the non-circular protrusion on the bracket with the non-circular bushing resists rotation between the bracket and the bushing.

* * * * *